US006240847B1

(12) United States Patent
Zoll et al.

(10) Patent No.: US 6,240,847 B1
(45) Date of Patent: Jun. 5, 2001

(54) PRINTING MACHINE STATE DISPLAY

(75) Inventors: Matthias Zoll, Mainz; Markus Schepp, Friedrichsdorf, both of (DE)

(73) Assignee: MAN Roland Druckmaschinen AG (DE)

( * ) Notice: Subject to any disclaimer, the term of this patent is extended or adjusted under 35 U.S.C. 154(b) by 0 days.

(21) Appl. No.: 09/365,384

(22) Filed: Aug. 2, 1999

(30) Foreign Application Priority Data

Aug. 5, 1998 (DE) ..... 298 13 976 U

(51) Int. Cl.[7] ..... B41F 1/54
(52) U.S. Cl. ..... 101/484; 101/486
(58) Field of Search ..... 101/484, 486; 400/74

(56) References Cited

U.S. PATENT DOCUMENTS 3,930,447 * 1/1976 Murray ..... 101/365
5,734,804 * 3/1998 Bergner ..... 395/113
5,937,149 * 8/1999 Lindner et al. ..... 395/113
6,112,658 * 9/2000 Gunther et al. ..... 101/171

* cited by examiner

*Primary Examiner*—John S. Hilten
*Assistant Examiner*—Charles H. Nolan, Jr.
(74) *Attorney, Agent, or Firm*—Leydig, Voit & Mayer, Ltd.

(57) ABSTRACT

A device is described for the state display for a printing machine, more specifically a sheet offset printing machine. The printing machine has a control, which is usually a computer, that communicates with several sensors and with a display device/computer. These sensors are located throughout the printing machine and can detect the position of certain elements of the machine. The invention extends the traditional printing machine state display so that it not only displays the simple state of the machine but also monitors previous states and can accomplish complex analysis of machine malfunctions. To accomplish this, the invention uses a storage device, which contains data on the representation and configuration of the machine and the sensors located in the printing machine. The control receives the data from the sensors and the storage device and sends graphical data to another computer that may process the information and present it to a display device.

10 Claims, 2 Drawing Sheets

PRINTING MACHINE STATE DISPLAY

TECHNICAL FIELD

This invention relates generally to printing machines and, more particularly, to an arrangement for the state display of a printing machine.

BACKGROUND OF THE INVENTION

Printing machines and especially sheet offset printing machines have a large number of adjustable/movable elements, which may be arranged in a number of ways. For example, there are shift protectors, stack-carrying plates, and rollers. Printing machines also include a large number of exchangeable parts such as cylinders and rollers. These elements have a number of functions, which may be monitored and are triggered by the printing machine control. The control may consist of one or several computers that are connected to sensors within the printing machine.

The printing machine, in particular the sheet offset printing machine, is usually controlled by a control station allocated to that machine. The control station may have a monitor that displays the state of the machine. A user may set or modify data by selecting the appropriate input menus. The monitor of the control station may have a visual representation of the printing machine, such as a diagram to display the state.

Due to the large number of movable parts of the sheet offset printing machine and the numerous ways they may be arranged, the printing machine can place a very high demand on its users, especially when the machine malfunctions. Because of the complexity of these malfunctions, the situation is not easily resolved. The large number of parts makes it difficult to pinpoint the cause immediately. Some groups have tailored their own response process to make it possible to locate the corresponding cause and to minimize down time of the machine.

It is known in the industry for a sheet offset printing machine to have a machine diagram displayed on a panel, in which the individual elements like cylinders and rollers, are represented. Sensors are placed within the printing machine at various locations to gather the information that is displayed in the panel. In addition, the operating state of certain elements may be displayed by illuminating certain areas of the display. Thus, a user may be able to determine why the machine is malfunctioning. For example, information may be displayed on the panel that discloses one of the devices not visible from the outside may not be completely closed.

The major limitation of this type of setup is that the display can only represent a limited amount of components with their corresponding states. Furthermore, the display can only show the current state of a component. Thus, it is not very useful in determining how the component/machine came to be in that state and the possible states it may enter from its current position.

SUMMARY OF THE INVENTION

To overcome these limitations, the invention is generally realized as an extension of the traditional state displays for printing machines. The invention provides a simple state display, detailed visualization of the printing machine, a history of previous states, and analysis of states. Several information gathering devices are placed throughout the printing machine. These devices monitor different components of the printing machine and are used to determine the current state, i.e. the position, of certain components. The devices then send their signal to an intermediate control device, like a computer. The computer can analyze the signal and store any useful information. The computer can do a complete and complex analysis of all the signals. Once the signal is processed, the computer sends its analyzed data as well as graphical information to the display. The display can then be a proper medium for visualization of the entire printing machine.

The display also may have many options for the user to choose from to manipulate the data. The computer may receive any input from the user via the display. It will process the user's request and update the display appropriately. The initial graphical display shows an overall state of the printing machine. By inputting commands via the display, the computer can update the display with more in depth information about a particular component/state or a more detailed view of a particular area of the printing machine.

Additional features and advantages of the invention will be made apparent from the following detailed description of illustrative embodiments which proceeds with reference to the accompanying figures.

BRIEF DESCRIPTION OF THE DRAWINGS

While the appended claims set forth the features of the present invention with particularity, the invention, together with its objects and advantages, may be best understood from the following detailed description taken in conjunction with the accompanying drawings of which:

DETAILED DESCRIPTION OF THE INVENTION

Figure 1:
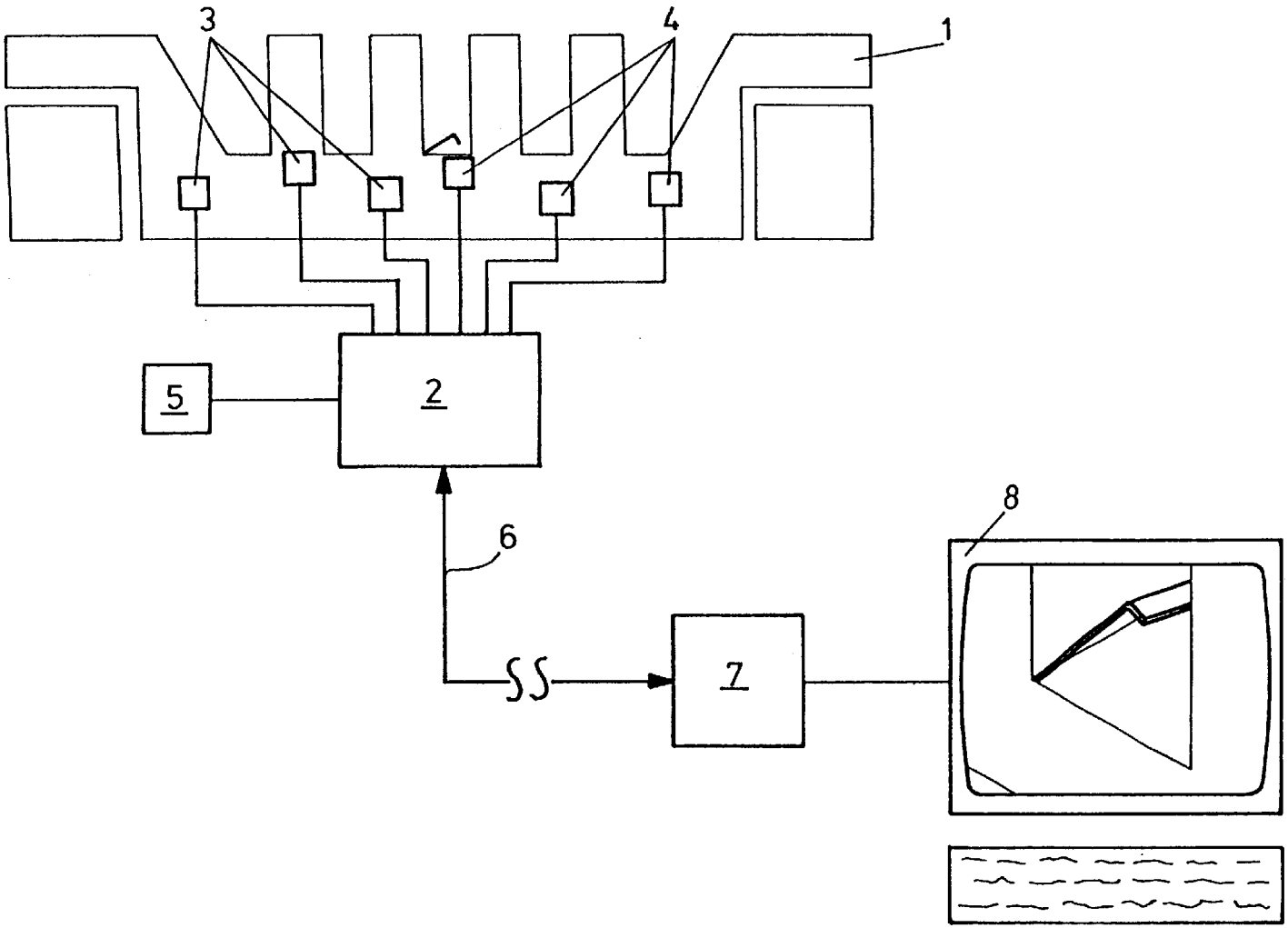
FIG. 1 is a block diagram generally illustrating the setup of equipment in which the present invention resides.

In accordance with the invention, the printing machine is constructed as a sheet offset printing machine 1 that has control device 2 which may be a computer, electrical, or mechanical device. The control 2 receives signals from both the sensors 3 and the end switches 4. The sensors 3 and end switches 4 monitor the positions of the certain elements of the printing machine 1 and forward any change in state to the control 2. The control 2 also communicates with the storage component 5. This storage component 5 contains the configuration of the printing machine and the possible states for the components of the printing machine 1. In particular, the storage component 5 will usually contain information on the following modules: feeders, printing mechanisms, lacquering arrangements, dryers, dischargers, and others.

When the printing machine 1 or control 2 is activated, the data stored in the storage component 5 that contains the configuration of the printing machine 1, the information received by the sensors 3, and the end switches 4 is sent via a data transmission element 6 to a computer 7. The computer 7 will send graphical information to the display 8. The graphical data may contain three-dimensional views of the various elements of the printing machine. Using an input device 9, such as a keyboard or a mouse, the user can select various options that will effect the display. The user can change the model of the machine as well as the viewing angle. The display 8 will correspondingly update the view due to input by the user or changes in the state of any of the elements in the printing machine.

Figure 2:
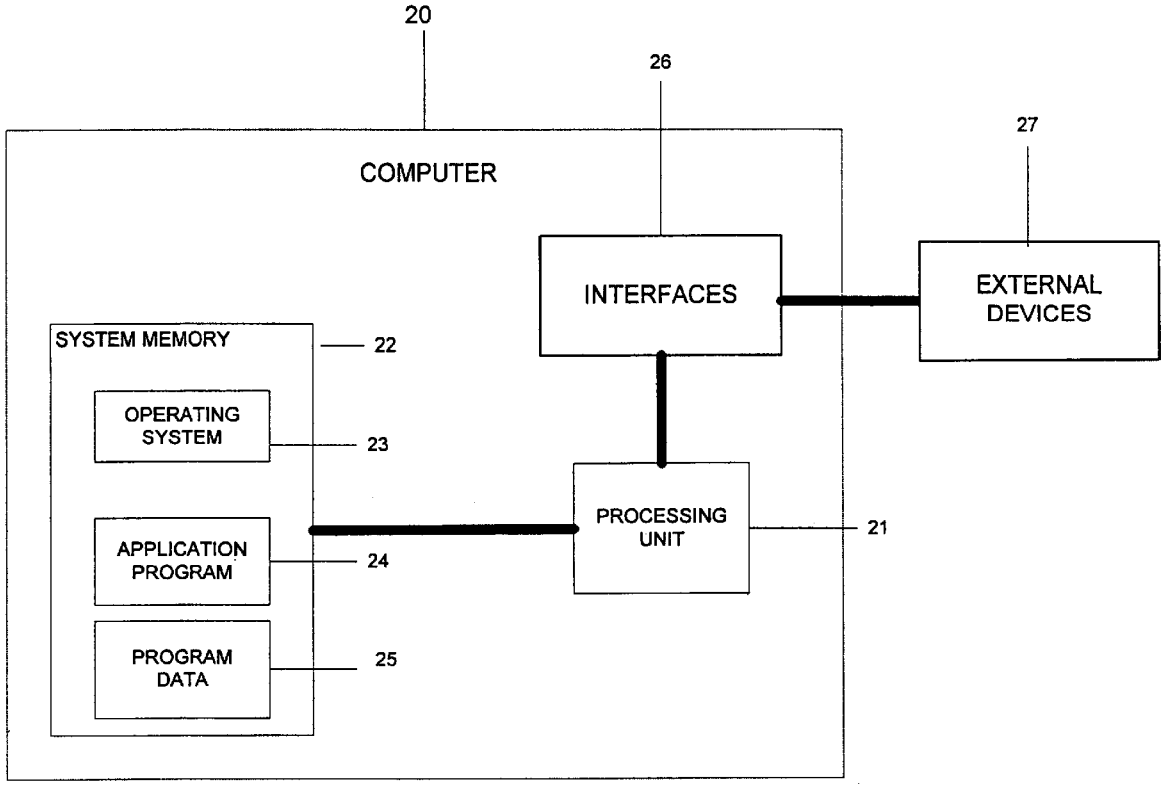
FIG. 2 is a diagram of a simple computer which may compose part of the present invention.

FIG. 2 represents a computer that may be used in the setup described above. For one skilled in the art, a computer may contain many different embodiments. A simple version is given here. The computer 20 is comprised of at least one processing unit 21 that controls the computer's actions. The processing unit 21 will use the system memory 22 to aid in computations such as analysis of data. The system memory 22 may be comprised of an operating system 23, an application program 24, and program data 25. Data and bits of information, like commands, may travel between these components and the processing unit 21. The processing unit 21 may be connected to one or many interface devices 26. These devices will connect the processing unit 21 to other internal or external devices 27. The external devices may include traditional input/output devices like mouses, keyboards, and display monitors. Or they may be more sophisticated like networks, the Internet, and virtual reality machines.

In the preferred embodiment, the invention should have at least one computer allocated to the control of the printing machine ("the control computer"). When the printing machine or the control computer is operating, data should be flowing from the printing machine sensors to the display giving the user a current visualization of the entire printing machine. The printing machine sensors may be end switches, sensors, setting drives, or any other similar device that may send signals about the individual components of the printing machine. The receiver of the control computer will collect these signals. The sensors are continuously transmitting data, so the receiver will always contain information on the current operating state.

The control computer will also receive data from the storage unit. The storage unit may be any type of device that can store information about the printing machine, like a punch card, read only or random access memory. The storage device will contain information about the printing machine. This would probably include the different elements, their possible states, their placement within the machine, and which states are invalid. The storage device information combined with the information from the sensors are gathered in the control computer. The control computer can then send the visualization information and the current operating state of the components to another computer ("the visualization computer"). The visualization computer is connected to a display unit. This second computer will evaluate the data relating to the printing machine configuration and the components various operating states to develop a visualization of the printing machine to be displayed. It will be appreciated that the visualization computer, the control computer, the display, and the storage unit can reside within a single computing device.

Each control computer should be allocated to a visualization computer. The monitor of the visualization computer will then present the graphical representation of the particular operating state of the components of the printing machine. It may present the whole printing machine or selected views. The monitor may display this information either by a three-dimensional ("3D") machine diagram, a selectable model, or some other form of representation. If feasible, the user may select different viewing angles, enlarge, or minimize to inspect the various elements of the printing machine. Each new view should display the image in a proportional manner. The user may also select a search in which any faulty elements or states are displayed. The visualization computer could also display exact time analysis of printing machine malfunctions. The user would be able to recall the sequence of each element's operating state up to the time it malfunctioned.

In addition, it should be possible to interactively form different representations of the machine state based on commands from the user. The user can control the printing machine by using the display, input devices, and the computer. For example by using an input device like a keyboard or a mouse, the user can select the visual representation of one of the printing machine's gates. This could toggle the state of this element between open and close. However, the visualization computer would first analyze the user's input to ensure equipment and personnel safety. Any input command may be ignored if that action would put a person or machine in physical danger.

In order to facilitate the 3-D representation, virtual reality ("VR") technology may be used. The 3-D display of the visualization computer would preferably be done in a 3-D modulation language that uses functional elements such as specified in 2.0 VRML (virtual reality modeling language) script language. When the printing machine or control computer is activated, a corresponding 3-D printing machine model can be generated from the machine configuration data. To facilitate this 3-D representation, the storage unit may store the basic elements of the printing machine as VRML data sets.

One option to enhance the visualization of the-printing machine is to use video cameras in addition to the sensors. The cameras may be mounted within the printing machine or handled by a person. The video camera could be connected to either computer. The graphical data feed to this computer can then be displayed on the monitor at the request of the user in conjunction with the information being sent from the control computer. With the use of the video cameras, the user may zoom in or zoom out on selected components or move the video camera to get a better angle of a particular element. The user may also choose which view point they wish to use or the visualization computer can select the optimal view.

Another embodiment would be to have the visualization computer represent the printing machine, for example as a 3-D model, and transmit this display to any other computer in a network. This will allow other users to perform remote diagnostics on the printing machine. A more likely scenario is to have the visualization computer at a different physical location then the printing machine. The control computer may be connected to a network or some other medium to the visualization computer at another location. For instance, a company operating several plants can monitor all their printing machines at a central office location on one visualization computer. The visualization computer would receive the printing machine configuration and operating state in the same manner. This embodiment may save time and money by allowing less equipment and reducing the need for on site personal. The central office would likewise be able to send commands to the control computer. Minor on site maintenance can be accomplished remotely with the central office expert giving instructions over the phone or by some other communication device.

All of the references cited herein, including patents, patent applications, and publications, are hereby incorporated in their entireties by reference.

In view of the many possible embodiments to which the principles of this invention may be applied, it should be recognized that the embodiment described herein with respect to the drawing figures is meant to be illustrative only and should not be taken as limiting the scope of invention. For example, those of skill in the art will recognize that the elements of the illustrated embodiment shown in software may be implemented in hardware and vice versa or that the illustrated embodiment can be modified in arrangement and detail without departing from the spirit of the invention.

Therefore, the invention as described herein contemplates all such embodiments as may come within the scope of the following claims and equivalents thereof.

We claim:

1. A device for displaying the state of a printing machine comprising:

sensors located within the printing machine whose signals are representative of relative positions of elements of the printing machine;

a storage device for storing data about a printing machine configuration, wherein the data includes placement of the elements in the printing machine and possible states of the elements;

a control computer connected to the sensors and the storage device that outputs graphically workable data from the signals generated by the sensors and the data from the storage deice; and a visualization computer in communication with the control computer control computer is adapted to collect and process data from the storage device and the sensor, and the visualization computer is adapted to transform the processed data from the and responsive to the graphically workable data for transforming the data into a graphical representation of the placement and state of one or more of the elements in the printing machine that are then visualized on a display device.

2. The device of claim 1 wherein the control computer uses the data from the storage device to formulate a data representation of the printing machine.

3. The device of claim 1 wherein the display device may present a partial representation of the printing machine.

4. The device of claim 1 wherein the graphical representation is in three-dimensional format.

5. The device of claim 1 wherein the visualization computer in conjunction with the display device present a model in which detailed portions of the display may be selected and viewed.

6. The device of claim 1 wherein the visualization computer in conjunction with the display device present a history of element states and a listing of malfunctioning elements.

7. A method for displaying a state of one or more elements of a printing machine, wherein the state is time dependent, the method comprising the steps of:

sensing a dynamic state of the one or more elements;

obtaining information describing a configuration of the one or more elements in the printing machine, wherein the configuration information includes possible states of the elements in the machine and placements of the elements in the machine;

processing the dynamic state of the one or more elements with the configuration information to create graphical data;

developing a visualization of the one or more elements in the printing machine from the graphical data, where the visualization includes the placement of the one or more elements in the printing machine and the dynamic state of the elements; and displaying the visualization of the one or more elements.

8. The method of claim 7 wherein the visualization includes a three-dimensional image.

9. The method of claim 7 wherein the step of processing includes:

conducting a time dependence analysis of the dynamic state of the one or more elements and the configuration information; and recalling a sequence of state information for the one or more elements.

10. The device of claim 4 wherein the three-dimensional diagram is created by a virtual reality technique.

* * * * *